US006059437A

United States Patent [19]

Shibuya et al.

[11] Patent Number: 6,059,437

[45] Date of Patent: May 9, 2000

[54] VEHICLE LAMP

[75] Inventors: Yuuzi Shibuya; Hidetsugu Yamamoto, both of Shizuoka, Japan

[73] Assignee: Koito Manufacturing Co., Ltd., Tokyo, Japan

[21] Appl. No.: 09/372,814

[22] Filed: Aug. 12, 1999

[30] Foreign Application Priority Data

Sep. 18, 1998 [JP] Japan ..... 10-264375

[51] Int. Cl.[7] ..... F21V 29/00

[52] U.S. Cl. ..... 362/547; 362/294

[58] Field of Search ..... 362/294, 547, 362/345, 373

[56] References Cited

U.S. PATENT DOCUMENTS

| | | | |
|---|---|---|---|
| 5,010,453 | 4/1991 | Ketterman | 362/547 |
| 5,497,308 | 3/1996 | Ohtsuka | 362/547 |
| 5,702,178 | 12/1997 | Smith | 362/294 |

*Primary Examiner*—Sandra O'Shea
*Assistant Examiner*—Hargobind S. Sawhney
*Attorney, Agent, or Firm*—Sughrue, Mion, Zinn, Macpeak & Seas, PLLC

[57] ABSTRACT

A vehicle lamp in which a lamp body has an air-hole structure with improved waterproofness and which can be easily molded. The air-hole structure includes an air hole 101 opened in the back of a lamp body 11 and a waterproof cover 106 which is formed integrally with the lamp body and capable of bending so as to cover the air hole 101. Upper wall, side wall and front wall portions 108, 111 and 109 of the waterproof cover 106 are integrally formed so as to cover corresponding upper-, lateral- and front-side areas of the air hole 101, respectively, when the waterproof cover is subjected to bending. The upper wall portion 108 of the waterproof cover 106 is coupled to the lamp body so as to be elastically bendable. The waterproof cover 106 is formed integrally with the upper wall, side wall and front wall portions 108, 111 and 109 so as to cover the upper-, lateral- and front-side areas of the air hole 101. Consequently, water is effectively prevented from penetrating into the air hole 101 through these areas to thereby improve the waterproofing effect. Since the waterproof cover 106 is held in such a condition that the air hole is securely covered by making an engaging hook 113 provided with the waterproof cover 106 for engaging with a retaining plate 105 provided with the air hole 101, a slider for making a mating hole can be dispensed with.

9 Claims, 6 Drawing Sheets

VEHICLE LAMP

BACKGROUND OF THE INVENTION

1. Field of the Invention

This invention relates generally to vehicle lamps installed in vehicles such as automobiles having an air-hole structure for ventilating a lamp chamber and essentially consisting of a lamp body and a front lens. More particularly, this invention relates to a vehicle lamp so constructed as to improve waterproofness in such an air-hole structure.

2. Related Art

In vehicle lamps such as automobile lamps, a lamp body and a front lens are normally used to form a lamp chamber in which a reflector, a light source and the like are contained. If such a lamp chamber is airtight, moisture existing in the lamp chamber will not be allowed to escape therefrom. When the outside air temperature lowers, the moisture condenses on the front lens and results in the deterioration of the light-distribution characteristics of the lamp, or the degradation of the external appearance of the lamp. For the reason stated above, an air hole for communicating the inside of the lamp chamber with the outside air has, heretofore, been provided in several places of the lamp body. However, simply making the air hole allows rain or muddy water to penetrate into the lamp chamber through the air hole, thus impairing the function of the lamp. Consequently, it has been proposed to provide an air-hole structure using a cover for covering the air hole in order to secure ventilation and to prevent water from penetrating from the outside.

FIGS. 6(*a*) and 6(*b*) are perspective views of an example of such an air-hole structure; and FIG. 7 is a vertical sectional view thereof. A cylindrical air hole 201 for communicating the inside of a lamp chamber with the outside thereof is made in a plurality of places vertically in the back of a lamp body 11. An outer cylindrical wall 202 having a cutout is provided on the circumferential lower side of the outer periphery of each air hole 201, and rectangular waterproof walls 203–206 are uprightly provided on the respective four peripheral positions of the air hole 201. A rectangular, plate-like waterproof cover 207 capable of bending (i.e., elastic) deformation is integrally coupled to the waterproof wall 203 positioned on the upper side of the lamp.

In this example, the waterproof cover 207 is capable of bending deformation at its coupling portion 208. As shown in FIG. 6(*b*), a projection 211 formed at the leading end of the waterproof cover 207 mates with a retaining hole 210 provided in the lower-side waterproof wall 206 when the waterproof cover 207 is subjected to the bending deformation so as to be substantially perpendicular to the lower-side waterproof wall 206 so that the area surrounded by the waterproof walls 203–206 can be covered with the waterproof cover 207, and so that the air hole 201 can be covered with the waterproof cover 207 and the waterproof walls 203–206.

The outside water which is likely to penetrate into the lamp chamber through the air hole 201 can thus be blocked by covering the air hole 201 with the waterproof cover 207 and the waterproof walls 203–206 and further with the outer cylindrical wall 202 and the cylindrical wall of the air hole 201. On the other hand, ventilation in the lamp chamber from the outside is secured through the gaps between the respective waterproof walls 203–206, the gaps between the respective waterproof walls 204 and 205, and the cutout of the outer cylindrical wall 202. Normally, arrangements for increasing the air permeability of the lamp chamber are often adopted by providing an air-hole structure of this sort in the upper and lower portions of the lamp body and circulating air within the lamp chamber through the upper and lower air holes.

Although ventilation is secured through the gaps between the waterproof cover 207 and the respective waterproof walls 203–206 in the conventional air-hole structure, the outside water is conversely allowed to penetrate into the waterproof walls 203–206 through the gaps and may penetrate into the lamp chamber through the air hole 201 unless the dimensions of the gaps are precisely controlled because the gaps formed with the waterproof cover 207 and the respective edge portions of the waterproof walls 203–206 are extremely finely dimensioned. As the probability is high that the air-hole structure located on the upper side of the lamp body of the automobile in particular is exposed to rain and muddy water, moisture is allowed to readily penetrate into the lamp body. Since the waterproof cover is in the form of a flat plate, it is likely to undergo plastic deformation and causes the gap between the waterproof cover and the waterproof wall to be enlarged and this may reduce the waterproofing effect further.

The waterproof walls 203–206 and the waterproof cover 207 constituting the air-hole structure are resin-molded integrally with the lamp body. In the molding of the air-hole structure of the example above, molds K11 and K12 are provided with sliders S11 and S12, each escaping toward the upper and lower sides of the lamp and crossing the parting direction of the molds used for resin-molding the lamp body 11 as shown by arrows in FIG. 7. The slider S11 is used to form a concave groove 209 in a coupling portion 208 between the waterproof cover 207 and the lamp body 11. The slider S12 is used to form a retaining hole for retaining a projection provided at the leading end of the waterproof cover. Consequently, the resin molding procedure for the air-hole structure requires a space on both the upper and lower sides of the lamp. However, when the air-hole structure is required to be arranged right above or below a bulb-socket inserting hole formed in the back of the lamp body, for example, one of the sliders S11 and S12 will interfere with the sleeve of the bulb-socket inserting hole, thus restricting the movement of that slider. Therefore, the aforementioned air-hole structure becomes difficult to arrange.

SUMMARY OF THE INVENTION

An object of the present invention is to provide a vehicle lamp having an air-hole structure capable of improving the vehicle lamp's waterproofness as well as affording greater design freedom.

An air-hole structure according to the present invention is characterized in that the structure includes an air hole opened in the back of a lamp body and a waterproof cover which is formed integrally with the lamp body and used for covering the air hole when subjected to bending deformation; and in that the upper wall, side wall, and front wall portions of the waterproof cover are integrally formed so as to cover the upper-, lateral- and front-side areas of the air hole, respectively, when the waterproof cover is subjected to bending deformation; and wherein the upper wall portion thereof is coupled to the lamp body in such a way as to be capable of bending deformation. Further, part of the air hole has a retaining portion as an integral part, and an engaging piece is projected from the inner surface of the front wall portion of the waterproof cover and engages with the retaining portion of the air hole in a position where the waterproof cover has been subjected to the bending deformation so that the waterproof cover is held in the bent-deformed condition. A waterproof wall projected in the back of the lamp body is formed on both lateral sides of the air hole and the waterproof cover in the bent-deformed condition is positioned so that the waterproof cover and the outside of the waterproof wall are overlapped.

According to the present invention, the waterproof cover is formed integrally with the upper wall, side wall and front wall portions so as to cover the upper-, lateral- and front-side areas of the air hole. Consequently, water is effectively prevented from penetrating into the air hole through these areas thereby improving the waterproofing effect. Since the waterproof cover is held in such a condition that the air hole is covered therewith by making the engaging piece provided for the waterproof cover engage with the retaining portion provided for the air hole, moreover, a slider for making a mating hole can be dispensed with. Therefore, the mold structure is prevented from becoming complicated and can be so designed as to locate the air-hole structure in any desired position.

DETAILED DESCRIPTION OF THE PREFERRED EMBODIMENTS

An embodiment of the present invention will now be described with reference to the drawings.

Figure 1:
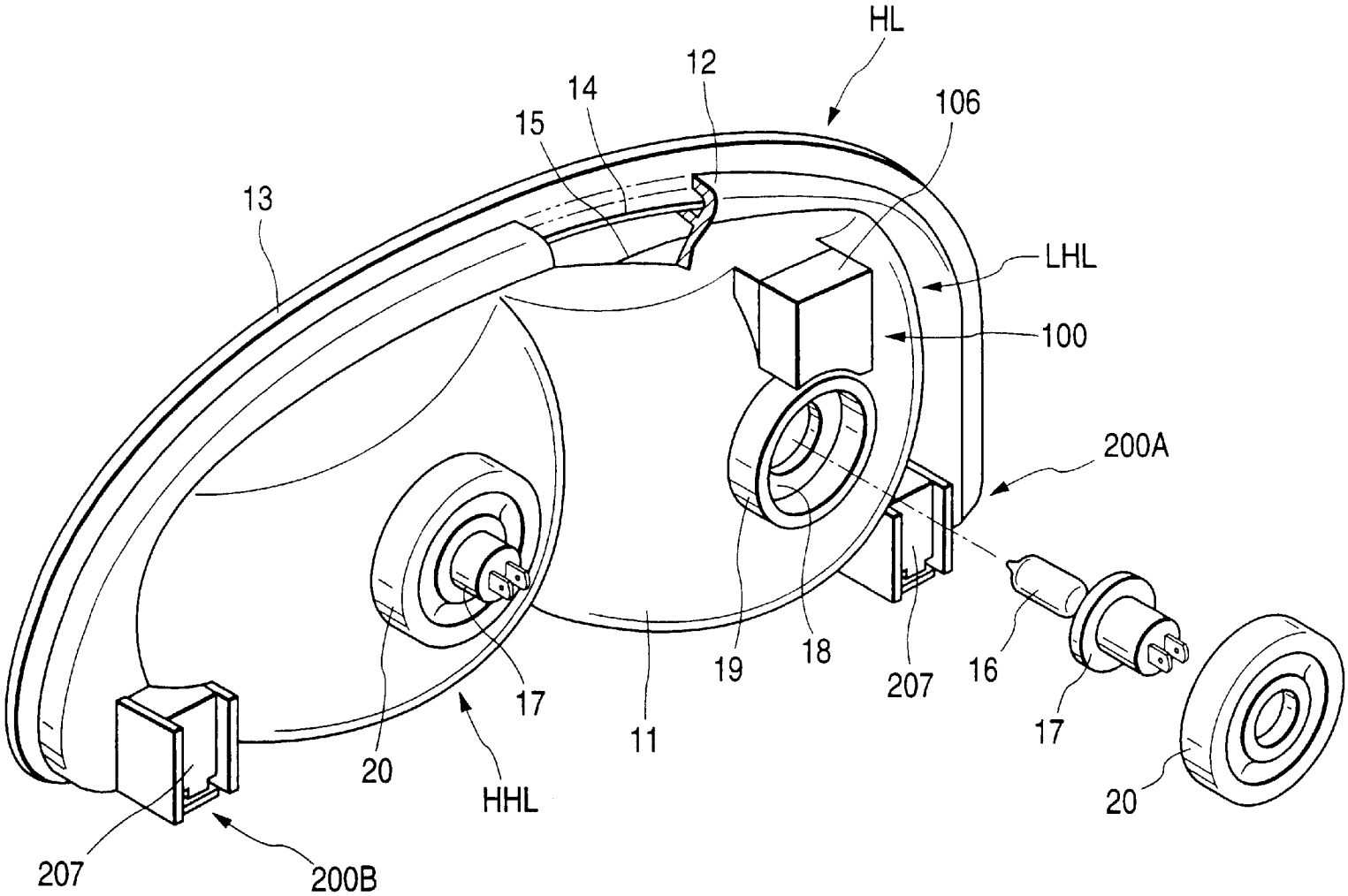
FIG. 1 is a schematic perspective view from the back of a headlamp to which the invention is applied.

FIG. 1 is a schematic perspective view of a headlamp on one side as seen from the back of a four-lamp type headlamp of an automobile to which the invention is applied. FIG. 1 illustrates the right-side headlamp HL including a high beam lamp HHL and a low beam lamp LHL which are integrally disposed in a lamp body 11.

More specifically, a front lens 13 is fitted into a sealing groove 12 extended along the open edge of the front opening of the resin-molded lamp body 11 in such a state that the peripheral edge portion 14 of the front lens has been inserted and sealed in the sealing groove 12. The front lens 13 and the lamp body 11 are used to form a lamp chamber in which a reflector 15 and a bulb 16 are contained to provide each of the lamps HHL and LHL. In the back of the lamp body 11 is a bulb-socket inserting hole 18 opened to dispose a bulb socket 17 for supporting the bulb 16 of each lamp in the lamp body 11. A sleeve 19 provided for the opening edge of the bulb-socket inserting hole 18 is covered with an annular rubber cap 20 in order to waterproof the gap between the bulb-socket inserting hole 18 and the bulb socket 17. In the back of the lamp body 11 one air-hole structure 100 is positioned right above the bulb-socket inserting hole 18 of the low beam lamp LHL, and two air-hole structures 200A and 200B are each positioned on the lower sides close to both the lateral ends of the lamp body 11.

Figure 6A:
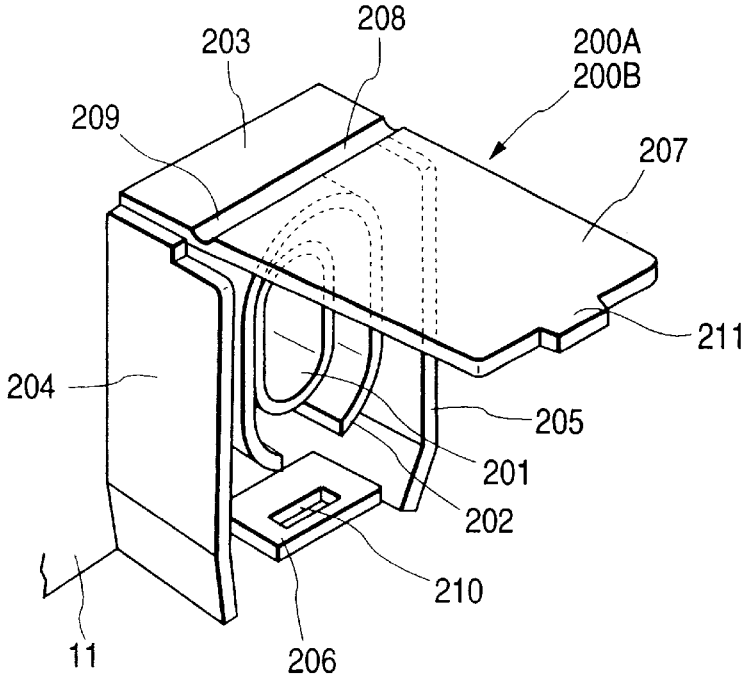
FIGS. 6(*a*) and 6(*b*) are perspective views of an example of a conventional air-hole structure.
Figure 6B:
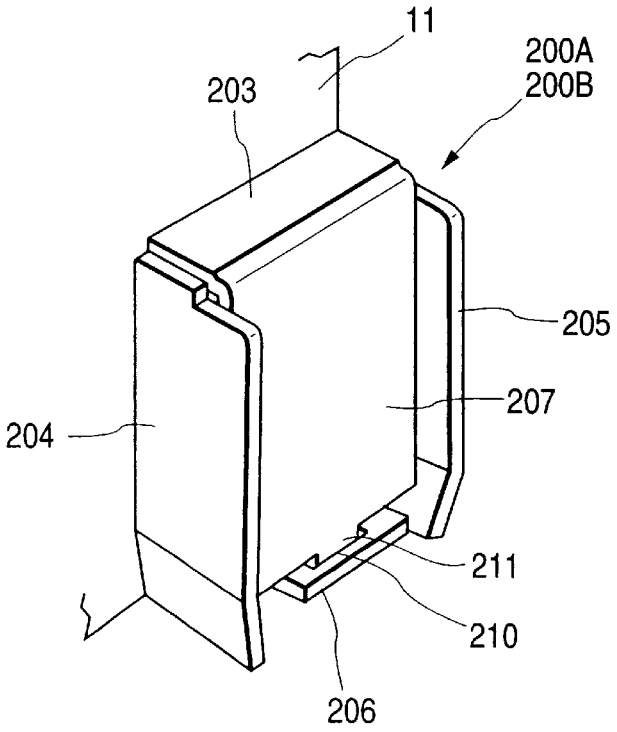

Of the three air-hole structures, the lower two air-hole structures 200A and 200B are those similar to conventional air-hole structures according to this embodiment of the invention. As shown in FIG. 6, the air hole 201 which is cylindrical in structure and used to communicate the lamp body with the outside is opened and there are provided the outer cylindrical wall 202 having a cutout portion on the lower circumferential side along the outer periphery of the air hole 201, and the upright waterproof walls 203–206 in such a way as to surround the vertical and lateral four peripheral sides. Furthermore, the waterproof cover 207 in the form of a rectangular plate is integrally coupled to the waterproof wall 203 located on the upper side of the lamp, and the coupling portion 208 is made thin-walled by forming the concave groove 209 from the surface side. Accordingly, the waterproof cover 207 can undergo bending deformation about the coupling portion 208. The opening of the air hole 201 is covered with the waterproof walls 203–206 and the waterproof cover 207 by subjecting the waterproof cover 207 to bending deformation so as to mate the projection 211 formed at the leading end of the waterproof cover 207 with the retaining hole 210.

With respect to this air-hole structure, the waterproofing effect is secured in the air hole 201 by the waterproof cover 207, the waterproof walls 203–206 and the outer cylindrical wall 202. The air permeability is also secured through the gaps between the adjoining waterproof walls 203–206 and between the waterproof cover 207 and the respective waterproof walls 204 and 205 on both sides and through the cutout portion of the outer cylindrical wall 202.

In such an air-hole structure similar to the conventional one, moisture may be allowed to penetrate through the gaps between waterproof cover 207 and the respective waterproof walls 204 and 205. However, the air-hole structure located below the lamp body 11 is less exposed to rain and muddy water than the air-hole structure located above the lamp body 11, and, therefore, little if any moisture is allowed to penetrate through the gaps from the outside. In other words, the aforementioned problem of moisture penetration is not as substantial with respect to the lower side of the lamp body 11.

Moreover, though the aforementioned sliders are required when the air-hole structures 200A and 200B are resin-molded integrally with the lamp body 11, the sliders are prevented from interfering with the lamp body because the air-hole structures are located in a position other than right above or below the bulb-socket inserting hole 18.

Consequently, it is easy to locate the sliders in positions where the sliders are allowed to escape up and down with respect to the lamp body, and the air-hole structures and the lamp body can be resin-molded together.

Figure 2A:
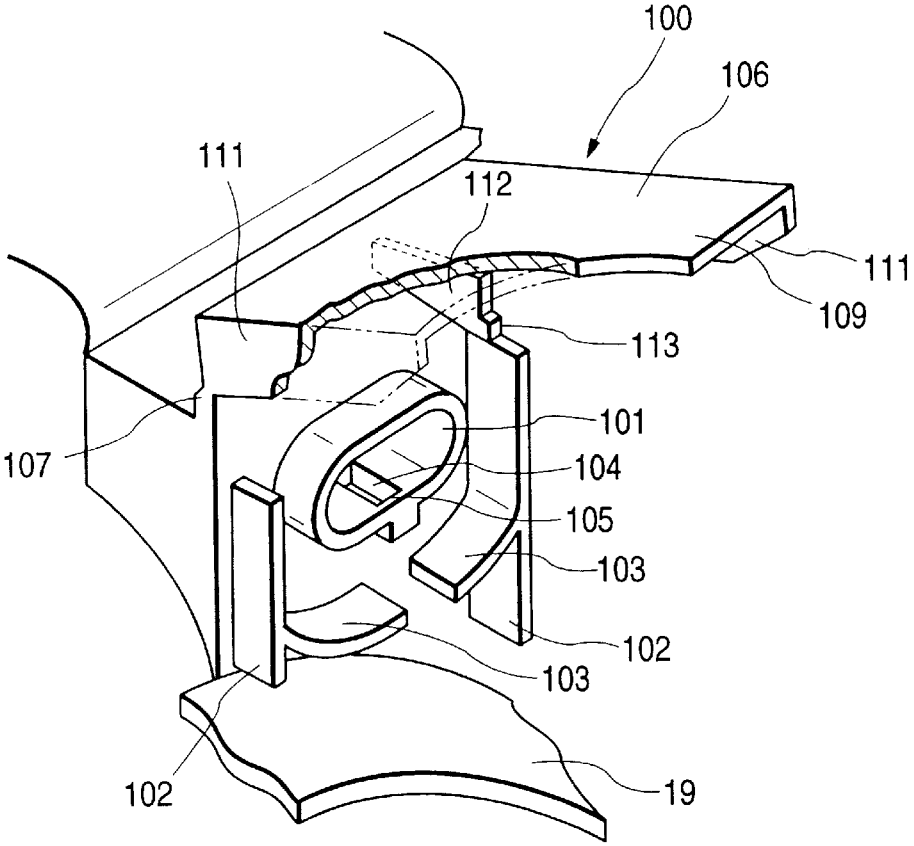
FIGS. 2(*a*) and 2(*b*) are a perspective view and a vertical sectional view, respectively, of an air-hole structure according to the present invention.
Figure 2B:
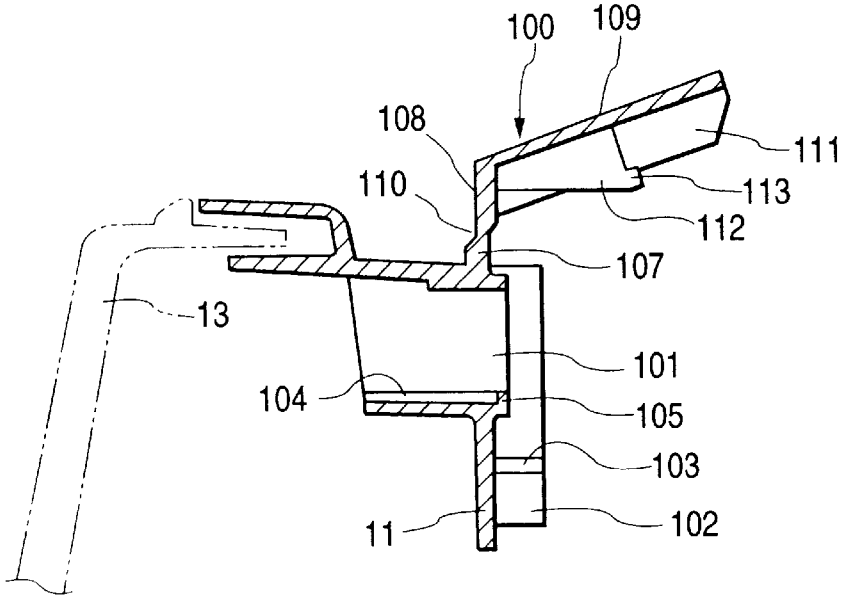

FIG. 2(*a*) is an enlarged perspective view of the air-hole structure 100 located above the lamp body 11; and FIG. 2(*b*) is a vertical sectional view thereof.

An elliptic cylindrical air hole 101 is opened in the back of the lamp body 11, and a pair of waterproof walls 102 having a predetermined length are vertically and uprightly provided, respectively on both sides of the air hole 101 held therebetween. An arcuate extended wall 103 is projected from the inner surface of each waterproof wall 102 along the lower side of the air hole 101. The leading end portions of the extended walls 103 are set opposite to each other with a very small gap therebetween right below the air hole 101. Moreover, a recessed groove 104 projected in the outer diametric direction along the cylindrical axis, that is, in the longitudinal direction of the lamp body 11, is formed in part of the lower-side circumference of the air hole 101. The outer end portion of the recessed groove 104 is blocked by a retaining plate 105. In this case, each of the air hole 101, the waterproof wails 102 and the extended walls 103 is resin-molded integrally with the lamp body 11.

A waterproof cover 106 having a length covering the pair of waterproof walls 102 over the horizontal direction of the lamp body 11 is resin-molded integrally with the lamp body 11 in a position along the upper side of the air hole 101. The waterproof cover 106 is in the form of an L-shaped plate material in cross section having an upper wall portion 108 projected upward from a projection 107 uprightly provided on the upper side surface of the lamp body 11, and a front wall portion 109 projected from the upper wall portion 108 in the back direction of the lamp body 11. The shape of the leading end of the front wall portion 109 according to this embodiment of the invention is formed so that part of the front wall portion is cut out arcuately along the circumference of the sleeve 19 of the bulb-socket inserting hole 18. A coupling portion 110 where the projection 107 of the lamp body 11 is coupled to the upper wall portion 108 is constricted in the longitudinal direction of the lamp body 11 with a thickness dimension smaller than the thickness of both the projection 107 and the upper wall portion 108. That is, the coupling portion is made thinner than the projection 107 and upper wall portion 108. Thus, the waterproof cover 106 is capable of bending deformation in the vertical direction of the lamp body 11 using the coupling portion 110 as a hinge. The height of the upper wall portion 108 is formed so that it is slightly greater than the length of the projection of the air hole 101 projecting from the back of the lamp body 11. The front wall portion 109 is formed slightly longer than the vertical length of the waterproof walls 102.

Additionally, side wall portions 111 projecting downward from the upper wall portion 108 over the front wall portion 109 are formed integrally with side wall portions 111 on the respective lateral sides of the waterproof cover 106. Furthermore, an integral tapered rib 112 is projected downward in the substantially central position in the lateral direction of the inner surface of the front wall portion 109, an engaging hook 113 being formed in the leading end portion of the rib 112. The length of the rib 112 is properly set so that the rib itself is able to secure the desired mechanical strength on the one hand, and so that the engaging hook 113 is brought into contact with the retaining plate 105 of the air hole 101 on the other.

Figure 3:
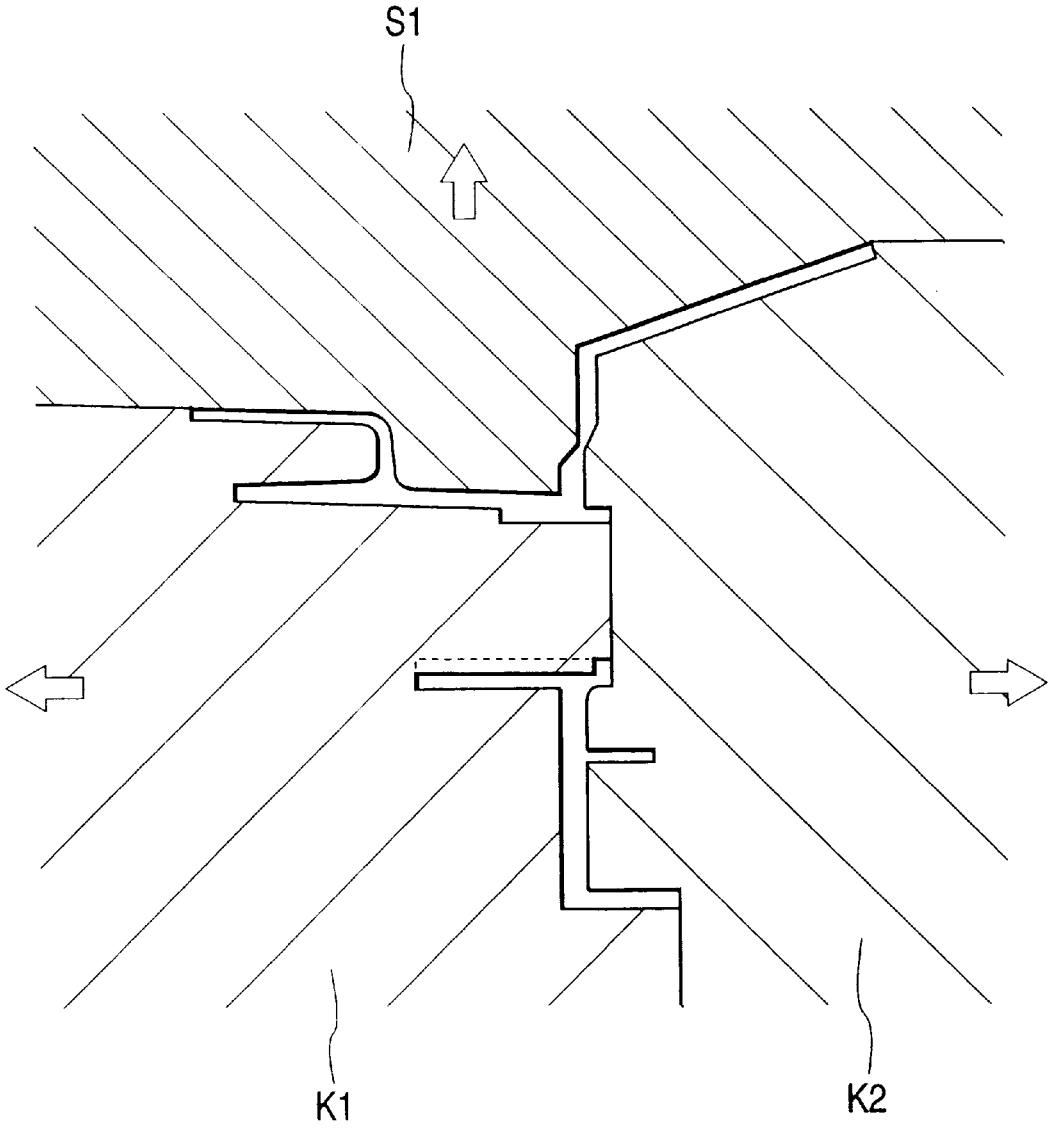
FIG. 3 is a sectional view of the principal part of molds for use in resin-molding the air-hole structure integrally with a lamp body.

With respect to the air-hole structure thus arranged, the air hole 101 and the lamp body 11 can be resin-molded together by a pair of molds K1 and K2 parting in the longitudinal direction of the lamp body 11 as shown in FIG. 3. In this case, the lamp body 11 requires no mating hole (210) for retaining the waterproof cover as before and since undercuts in the parting direction are absent in the lower-side areas of the molds K1 and K2, the resin-molding can be carried out by providing only one slider S1 escaping upward in order to mold the undercut portion produced between the waterproof cover 106 and the sealing leg portion 12 existing in the upper edge portion of the lamp body 11. For this reason, the movement of the slider S1 never interferes with the sleeve 19 existing on the peripheral edge of the bulb-socket inserting hole 18 even when the air-hole structure 100 is located right above the bulb-socket inserting hole 18 as stated above. Thus, the resin-molding can be carried out, whereas the mold structure can be simplified further.

Figure 4A:
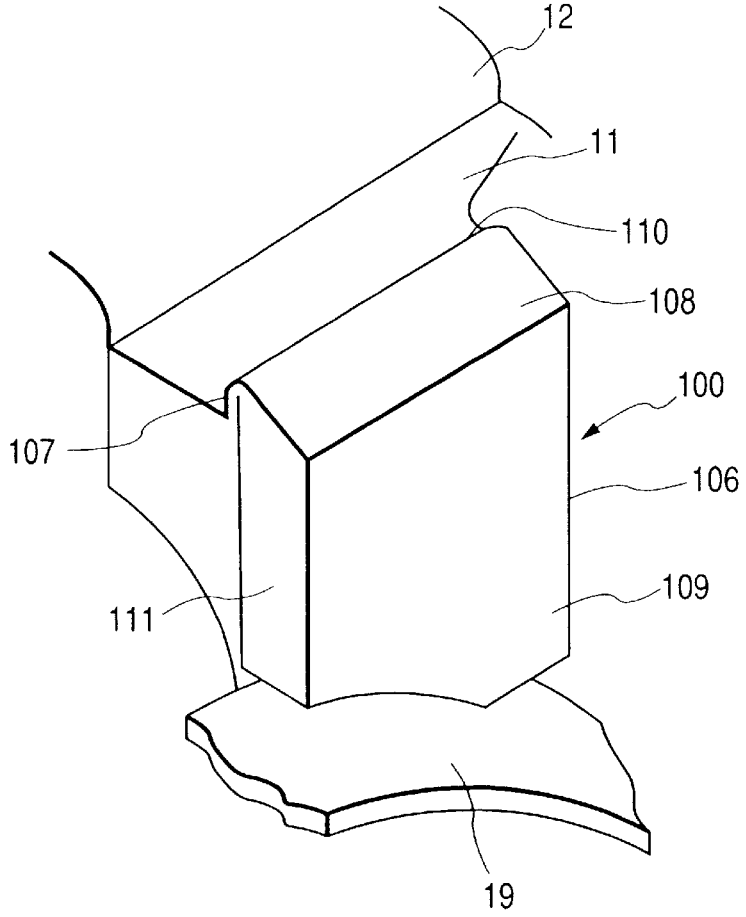
FIGS. 4(*a*) and 4(*b*) are a perspective view and a vertical sectional view, respectively, of the air-hole structure of FIGS. 2(*a*) and 2(*b*) in which the air hole has been covered.
Figure 4B:
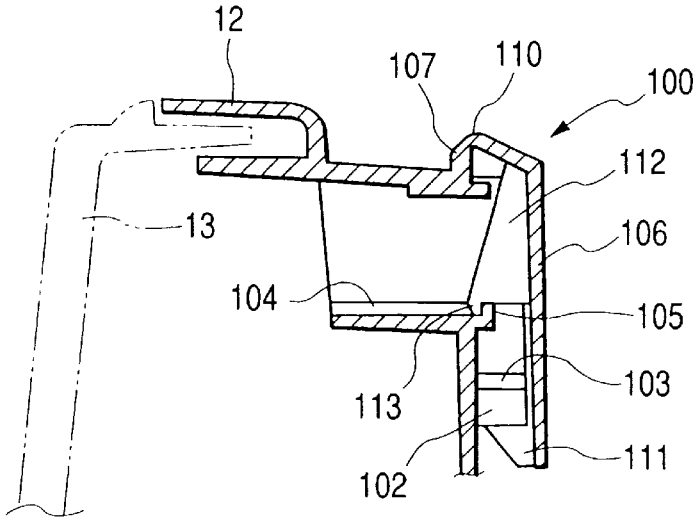

As shown in FIG. 4(*a*) which is a perspective view of the air-hole structure 100 and in FIG. 4(*b*) which is a vertical sectional view thereof, the engaging hook 113 of the rib 112 climbs over the retaining plate 105 of the air hole 101, and enters and remains in the recessed groove 104 when the waterproof cover 106 is subjected to a 90-degree downward bending deformation by utilizing the thin-walled deformable coupling portion 110. Thus, the engaging hook 113 is caused to engage with the retaining plate 105, whereby the waterproof cover 106 is held in the bent-deformed condition. In this condition, the upper-side area of the air hole 101 is covered with the wall portion 108 of the waterproof cover 106; the front-side area thereof is covered with the front wall portion 109 thereof; and the lateral-side areas thereof are covered with both the side wall portions 111 along the respective sides of the waterproof walls 102.

Figure 5:
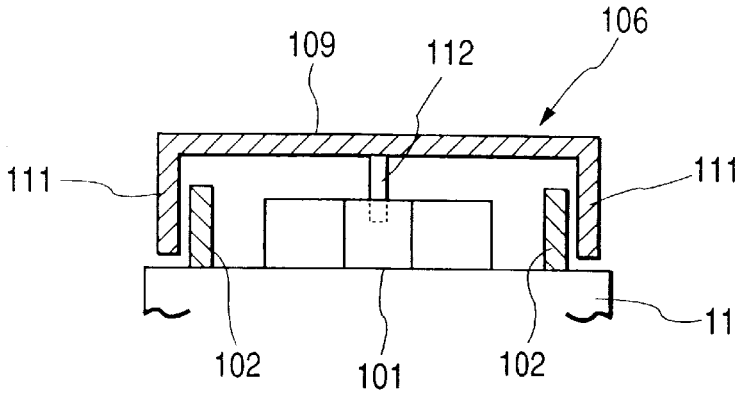
FIG. 5 is a horizontal sectional view of the air-hole structure in the state of FIGS. 4(*a*) and 4(*b*) as seen from below.
Figure 7:
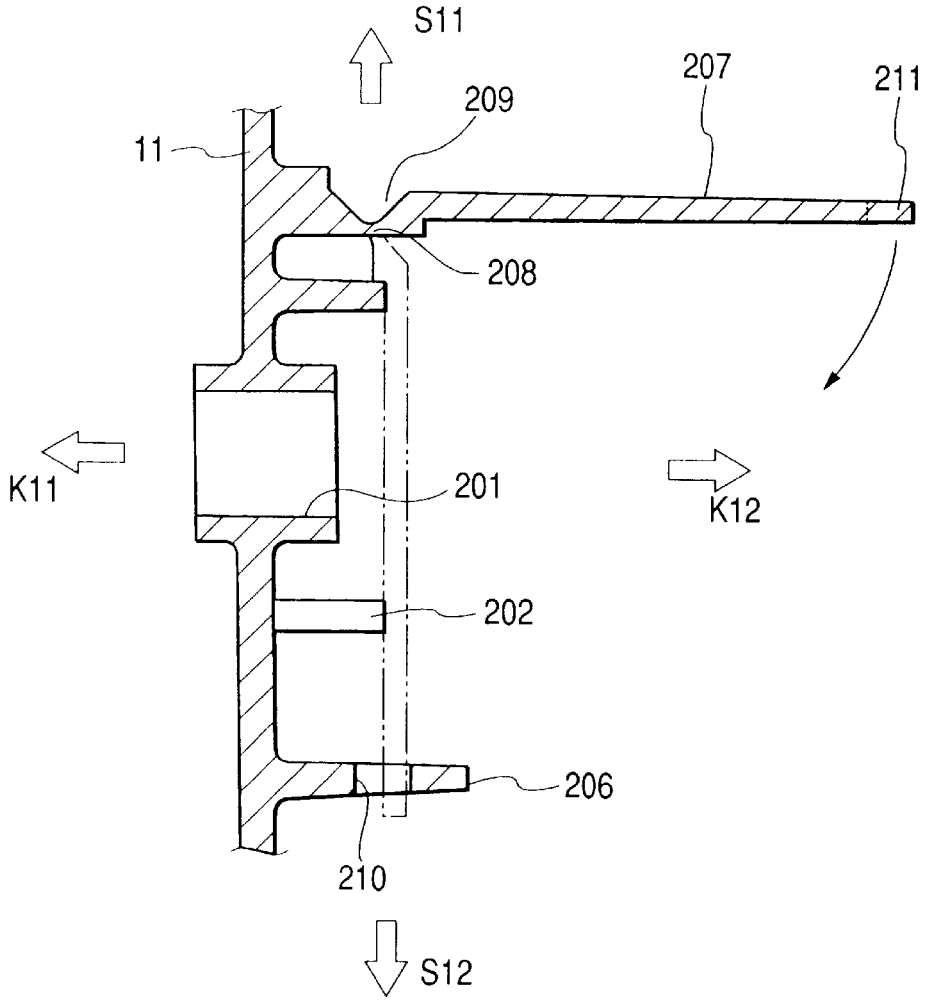
FIG. 7 is a vertical sectional view of the air-hole structure of FIGS. 6(*a*) and 6(*b*).

In the upper-side area, since the upper wall portion 108 has been coupled to the lamp body 11 in the coupling portion 110, no gap is produced between the upper wall portion 108 and the lamp body 11 to ensure that an extremely great waterproofing effect is achievable. In the lateral-side areas, moreover, the gap between the side wall portion 111 and the lamp body 11 is reduced to so-called labyrinth structure where the waterproof wall 102 exists as shown in a horizontal sectional view of FIG. 5 to ensure that an extremely great waterproofing effect is also achievable.

On the other hand, though there is produced a gap between the front wall portion 109 and the lamp body 11 in the lower-side area. Part of the circumference of the sleeve 19 of the bulb-socket inserting hole 18 of the lamp body 11 exists in the lower-side area of the air hole and so does the extended wall 108 from the inner surface of each waterproof wall 102. Consequently, the area of the air hole 101 exposed to the outside through the gap in the lower-side area is restricted by the sleeve 19 and both the extended walls 103, so that a great waterproofing effect is obtainable.

Thus, the external moisture is prevented by the waterproof cover 106 from penetrating into the air hole 101 from any of the upper, front and lateral directions. On the other hand, even in the bent-deformed condition of the waterproof cover 106, the front wall portion 109 and upper wall portion 110 of the waterproof cover 106 hold an extremely small gap with respect to the back of the lamp body 11 and the waterproof walls 102, and the intended function of the air-hole structure 100 is achieved because the ventilation of the lamp body 11 relative to the outside is secured through the gap and the air hole 101.

As described above, the waterproof wall 102 is installed on both sides of the air hole 101, and the waterproof cover 106 for covering the air hole 101 is provided with the upper wall portion 108 covering the upper-side area of the air hole 101, the front wall portion 109 covering the front-side area of the air hole 101, and the side wall portions 111 covering the lateral side areas of the air hole 101 in the air-hole structure 100 according to this embodiment of the invention. Accordingly, excellent waterproofness from any of the upper, lateral and front directions is provided for the air hole 101. Therefore, the air-hole structure can be employed for securing a great waterproofing effect when such an air-hole structure is arranged above the lamp body 11.

As resin-molding using one slider escaping up the lamp body 11 is possible, on the other hand, the air-hole structure can be located right above the bulb-socket inserting hole and this is advantageous in that positional restriction in locating the air-hole structure is minimized; design freedom is improved; the mold structure is prevented from becoming complicated; and lamp cost reduction is effectively implemented.

Since the air-hole structure 100 is located right above the bulb-socket inserting hole 18 of the lamp body 11 according to the aforementioned embodiment of the invention, the sleeve 19 of the bulb-socket inserting hole exists in the lower-side area of the air hole 101, and the gap in the lower-side area of the air hole is made narrower by the sleeve 19, which is effective in securing the waterproofing effect. Even when the sleeve is absent, however, the waterproofing effect is needless to say satisfactorily achievable in the lower-side area of the air hole by the extended walls 103 of the waterproof walls 102.

Although the air-hole structure according to the present invention has been applied to only the air hole located above the lamp body according to the aforementioned embodiment thereof, the air-hole structure according to the present invention may be employed for an air hole located below the lamp body.

Further, though the invention has been applied to the two-lamp type headlamp according to the aforementioned embodiment of the invention, the invention may be applied likewise to a single-lamp type headlamp or any other kind of lamp as long as the vehicle lamp is fitted with an air-hole structure for use in communicating a lamp chamber with the outside.

As set forth above, the waterproof cover for covering the air hole is formed integrally with the upper wall, side wall and front wall portions so as to cover the upper-, lateral- and front-side areas of the air hole when the waterproof cover is subjected to bending deformation. Consequently, water is effectively prevented from penetrating into the air hole through these areas, thereby improving the waterproofing effect.

In particular, the waterproofing effect from the upper-side area of the air hole can be improved to a greater extent as the upper wall portion of the waterproof cover capable of bending deformation is formed integrally with the lamp body. Since the waterproof cover is held in such a condition that the air hole is covered therewith by making the engaging piece provided for the waterproof cover engage with the retaining portion provided for the air hole, moreover, a slider for making a mating hole can be dispensed with. Therefore, the mold structure is prevented from becoming complicated and can be so designed as to locate the air-hole structure in any desired position.

It is contemplated that numerous modifications may be made to the air-hole structure of the present invention without departing from the spirit and scope of the invention as defined in the following claims.

What is claimed is:

1. A vehicle lamp, comprising:

a lamp body defining an interior chamber of said vehicle lamp; and an air-hole structure in a back of said lamp body, said air-hole structure communicating said interior chamber with an exterior of said lamp body, said air-hole structure comprising:

an air hole formed in the back of said lamp body, said air hole comprising an upper-side area, lateral-side areas, and a front-side area; and a waterproof cover movably coupled to said lamp body and integrally formed with said lamp body and comprising:

an upper wall portion corresponding to said upper-side area, side wall portions corresponding to said lateral-side areas, respectively, and a front wall portion corresponding to said front-side area;

wherein said waterproof cover covers said air hole when placed over said air hole so that said upper wall portion, side wall portions, and front wall portion cover said corresponding upper-side area, lateral-side areas, and front-side area, respectively.

2. The vehicle lamp as claimed in claim 1, wherein said waterproof cover is coupled to said lamp body at said upper wall portion.

3. The vehicle lamp as claimed in claim 2, wherein a waterproof wall projects from each of said lateral-side areas so that when said waterproof cover is placed over said air hole, said side wall portions of said cover overlap said waterproof walls, respectively.

4. The vehicle lamp as claimed in claim 1, wherein said air hole further comprises a retaining portion integrally formed therewith, and wherein said waterproof cover further comprises an engaging piece projecting from an inner surface of said front wall portion, said engaging piece engaging with said retaining portion when said waterproof cover is placed over said air hole.

5. The vehicle lamp as claimed in claim 1, wherein a waterproof wall projects from each of said lateral-side areas so that when said waterproof cover is placed over said air hole, said side wall portions of said cover overlap said waterproof walls, respectively.

6. The vehicle lamp as claimed in claim 5, further comprising an arcuate extending wall projecting from an inner surface of each of said waterproof walls at a bottom-side area of said air hole.

7. The vehicle lamp as claimed in claim 1, further comprising a bulb socket having a sleeve projecting out of the back of said lamp body, and wherein said air hole structure is positioned adjacent to said sleeve so that a bottom end of said front wall portion opposite said upper wall portion confronts a part of said sleeve, and wherein said bottom end of said front wall portion has a shape corresponding to the confronting part of said sleeve.

8. The vehicle lamp as claimed in claim 1, wherein a coupling portion coupling said waterproof cover to said lamp body is a thin walled portion which is elastically deformable.

9. A vehicle lamp, comprising:

a lamp body defining an interior chamber of said vehicle lamp, and an air-hole structure disposed in a back of said lamp body, said air-hole structure communicating said interior chamber with an exterior of said lamp body, said air-hole structure comprising:

an air hole formed in the back of said lamp body, said air hole comprising a first-side area, a second-side area, a third-side area opposite said second-side area, and a front-side area; and a waterproof cover movably coupled to said lamp body and integrally formed with said lamp body and comprising a first wall portion corresponding to said first-side area, second and third wall portions corresponding to said second- and third-side areas, respectively, and a front wall portion corresponding to said front-side area;

wherein said waterproof cover covers said air hole when placed over said air hole so that said first through third wall portions, and said front wall portion cover said corresponding first- through third-side areas and front-side area, respectively.

* * * * *